US005095990A

United States Patent [19]

Best et al.

[11] Patent Number: 5,095,990

[45] Date of Patent: Mar. 17, 1992

[54] METHOD AND DEVICE FOR SAND CONTROL

[75] Inventors: Donald A. Best, Calgary; Kevin C. Grondin, Olds, both of Canada

[73] Assignee: Mobil Oil Corporation, Fairfax, Va.

[21] Appl. No.: 603,354

[22] Filed: Oct. 26, 1990

[51] Int. Cl.[5] ..... E21B 43/08

[52] U.S. Cl. ..... 166/369; 166/227; 166/232; 166/228

[58] Field of Search ..... 166/231-236, 166/227, 228, 265

[56] References Cited

U.S. PATENT DOCUMENTS

| | | | |
|---|---|---|---|
| 1,488,753 | 4/1924 | Kelly | 166/205 |
| 2,118,171 | 5/1938 | Dorst | 166/236 |
| 3,025,914 | 3/1962 | Fether | 166/235 |
| 3,709,293 | 1/1973 | Layne, II et al. | 166/232 |
| 3,880,233 | 4/1975 | Muecke et al. | 166/205 |

FOREIGN PATENT DOCUMENTS

| | | | |
|---|---|---|---|
| 305914 | 3/1916 | Fed. Rep. of Germany | 166/235 |

*Primary Examiner*—Stephen J. Novosad
*Attorney, Agent, or Firm*—Alexander J. McKillop; Charles J. Speciale; Charles A. Malone

[57] ABSTRACT

A method and device for removing sand from hydrocarbonaceous fluids whereby a berm is formed adjacent to a slot which has penetrated a liner or perforated tube. The berm which is formed along each side of said slot operates to form a lip or platform so as to provide a solid base upon which to form a sand bridge to more effectively remove sand from hydrocarbonaceous fluids produced from the well.

11 Claims, 4 Drawing Sheets

PRIOR ART
FIG. 1a
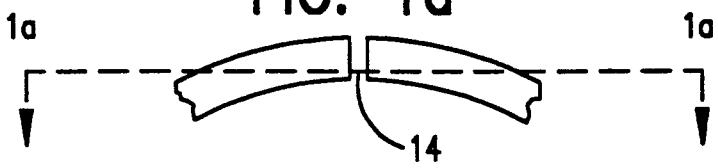
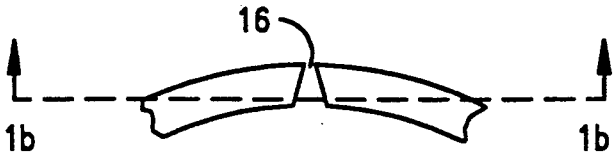
FIG. 1b
PRIOR ART
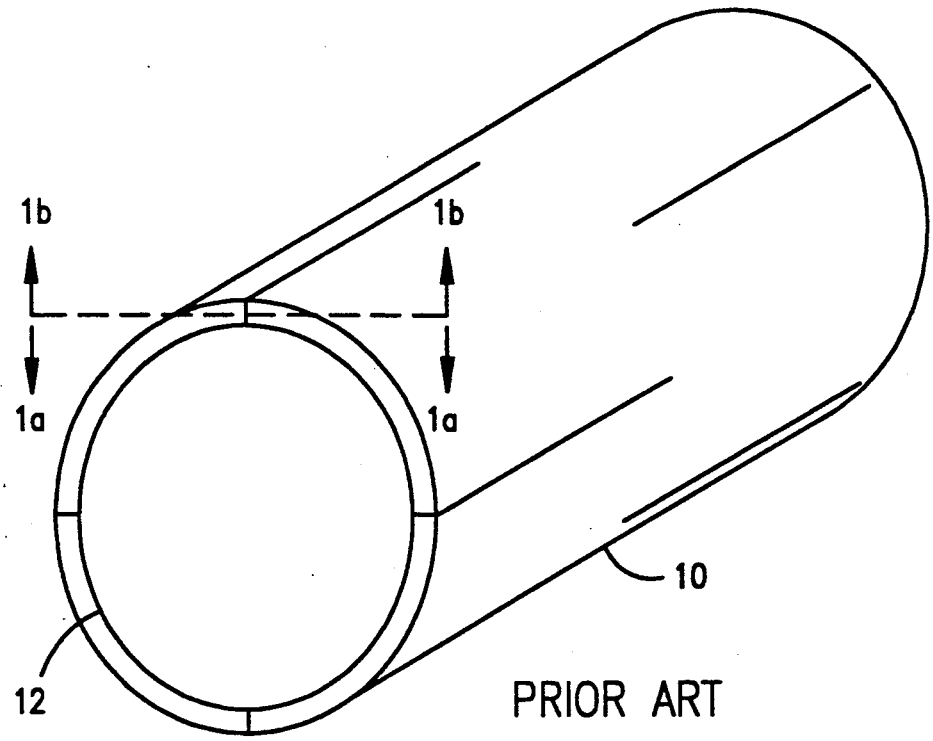
PRIOR ART
FIG. 1

FIG. 2a
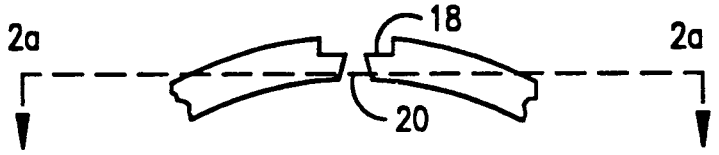
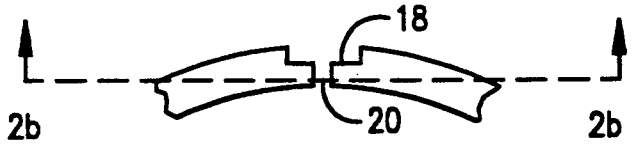
FIG. 2b
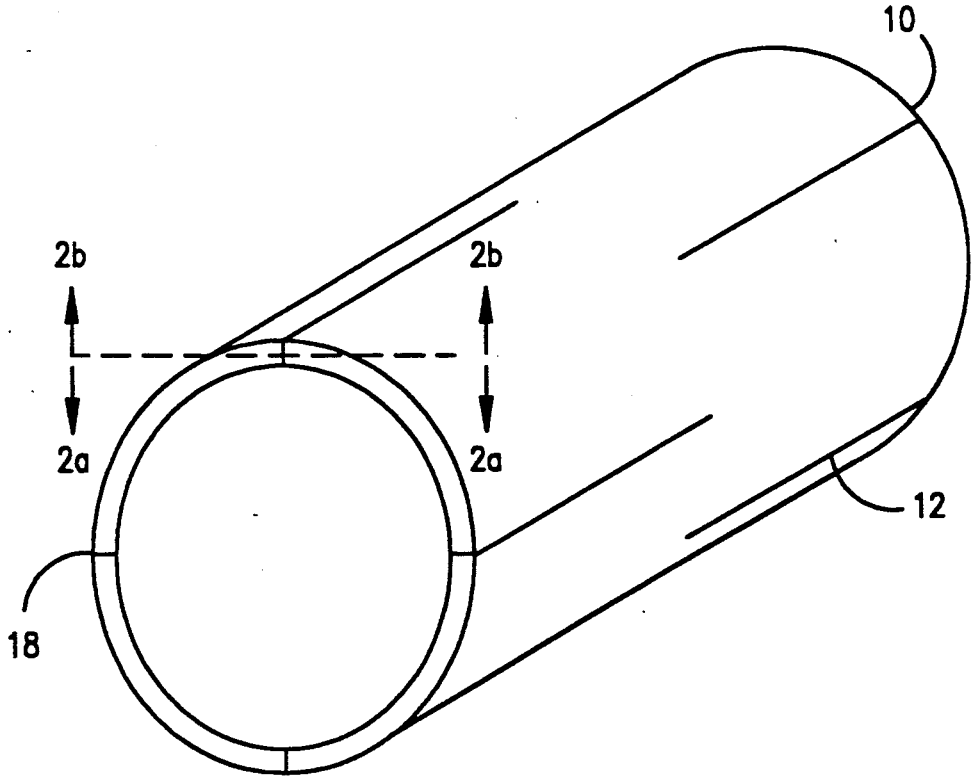
FIG. 2

METHOD AND DEVICE FOR SAND CONTROL

FIELD OF THE INVENTION

This invention relates to a method and device for retarding the production of sand in wells completed in subterranean formations. In one aspect, it relates to an improved screen for use in producing wells.

BACKGROUND OF THE INVENTION

Sand production in many oil and gas producing areas of the world is a serious problem which costs the industry several million dollars annually, either as a result of repairs or lost production. Recent trends towards higher production rates has resulted in high pressure differentials across formations and has increased the severity of sand control problems. If sand production is not arrested or controlled, sand entrained in produced fluids can severely erode production equipment and reduce well productivity.

Sand control techniques include use of mechanical devices to separate entrained sand at a subsurface location and thereby prevent solids from entering a producting well. These devices normally include a sand screen which serves to screen out sand or is used in conjunction with gravel pack completions. In either type of completion, the screen is provided with particularly sized openings to cause sand grains to bridge. In completions which employ a screen without an aggregate, the screen openings are sized in relation to formation particles to effect particle bridging. In gravel pack completions, screen openings are sized in relation to the aggregate used outside the screen; and the aggregate is sized in relation to formation sand. Size relationships of the aggregate and/or screen are normally determined by well-known techniques which are based upon sieve analysis data obtained from formation.

Recent studies have shown that the use of techniques based upon sieve analysis data frequently results in a screen having too large openings. Microscopic examinations of typical cores reveal that particle sizes classified by standard screen sieves are composed of clusters of loosely bound grains as well as individual grains. On a sieve analysis curve, the clusters are classified according to the cluster size instead of individual grain size. However, under producing conditions, individual grains break away from the cluster and migrate individually.

Therefore, what is needed is a method and apparatus to more effectively bridge sand on a screen to more efficiently remove sand from produced hydrocarbonaceous fluids.

SUMMARY

This invention relates to a method and apparatus for removing sand from oil produced from a formation. A sand control device is affixed to the end of a production tube or conduit so as to remove sand from oil produced to the surface. In one embodiment, the sand control device comprises a liner having at least one slot that penetrates the liner and extends radially or axially therealong. The slot has a berm longitudinally along each of its sides which causes a bridging of sand grains across said slot with a lip or platform formed by the berm. This results in substantially better sand control when producing hydrocarbonaceous fluids from the formation due to a substantially more stable and stronger sand bridge.

In another embodiment, the device is comprised of wire wrapped circumferentially around a perforated liner and separated from the liner by longitudidal spacer bars fixed to the perforated liner. As the wire is wrapped around the perforated lining, a gap is formed between adjacent rolls of wire over the entire length of the liner. The gap is formed so as to preclude entry of sand anticipated to be produced from the formation. The wire which is wrapped around the liner is shaped so as to have a raised axial portion with a berm longitudally along each side of the axial portion which results in a lip or platform along the berm. This causes a bridging of sand grains across said gap. This bridging of sand grains results in substantially better sand control due to a stabler and stronger bridge formation.

It is therefore an object of this invention to provide a berm along each side of a slot in the lining which will provide support from a sand grain build-up, thereby making a stabler and stronger bridge for effectively minimizing sand production.

It is yet another object of this invention to provide for an economical method for enhancement of a sand bridge along a slotted liner so as to minimize sand production.

BRIEF DESCRIPTION OF THE DRAWINGS

FIG. 1 is a schematic of a conventional sand control device or slotted liner.

FIG. 1*a* is an enlarged view of a conventional or regular slot within a slotted liner.

FIG. 1*b* is an enlarged view of a slotted liner which shows a conventional key stone slot.

FIG. 2 is a schematic view of a slotted liner with a slot containing a berm along each side of said slot.

FIG. 2*a* is an enlarged view of a slot which details a key stone version of a slot containing a berm along each side of said slot.

FIG. 2*b* is an enlarged view of the slotted liner showing a berm along each side of a regular slot.

DESCRIPTION OF THE PREFERRED EMBODIMENT

Figure 3:
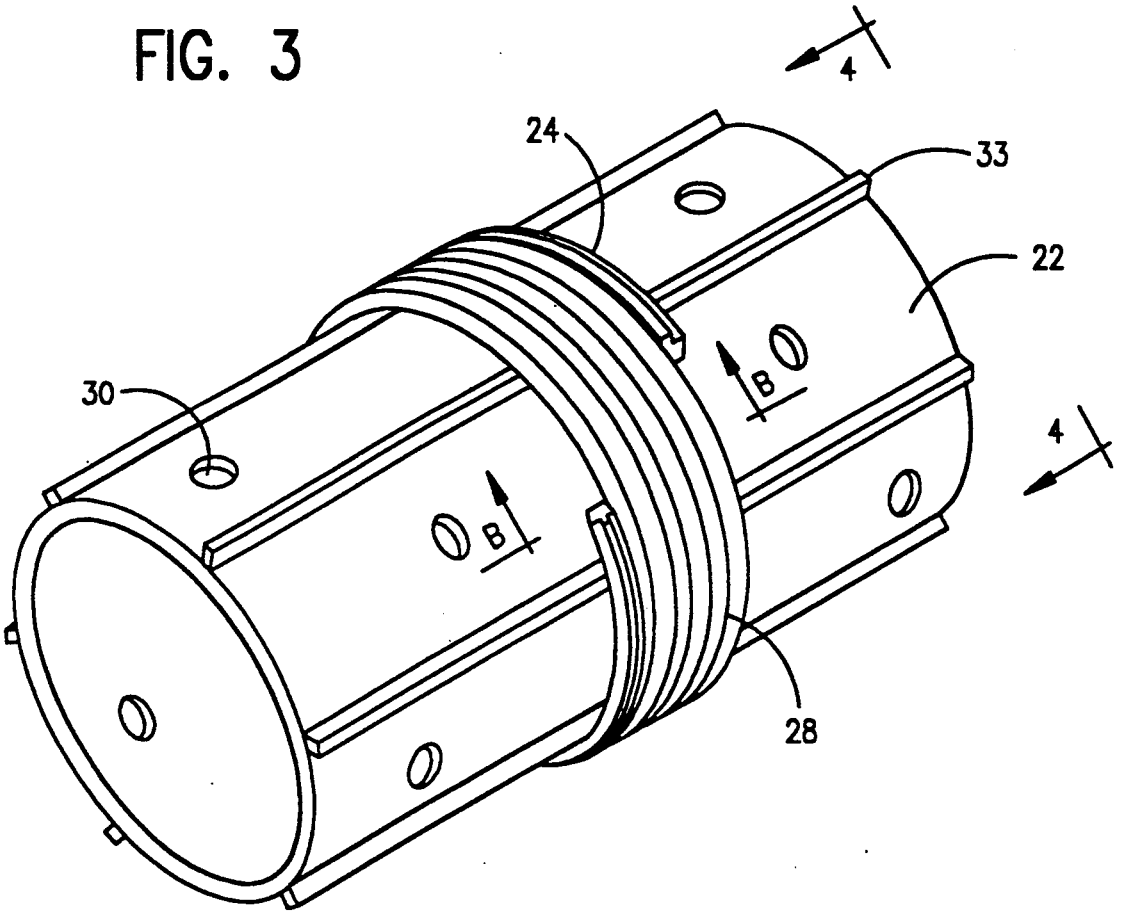
FIG. 3 is a perforated liner with longitudinal spacer bars which has a wire wrapped screen thereround.

The term "slotted liner" as used herein refers to a wide range of tubular goods provided with specially sized openings which are designed for use as subsurface filters in wells. Such devices are referred to in the art as "pre-perforated screens", "vertically slotted screens", "horizontally slotted screens", "pre-packed screens", "wire-wrapped screens", and the like. Said liners are commercially available in diameters ranging from about 1 inch to about 16 inches O.D. and lengths ranging from about 5 to several hundred feet. Openings in the screen which range from about 0.006 to about 0.60 inches are sized to screen out or bridge particular material entrained in produced fluids. Liners and a method for placement of said liners is described in U.S. Pat. No. 3,880,233 which issued to Muecke et al. on Apr. 29, 1975. This patent is hereby incorporated by reference herein. A conventional slotted liner with conventional slots therein is shown in FIGS. 1, 1*a* and 1*b*.

In the practice of this invention as shown in FIG. 2, a slot 12 of a desired width is cut through liner 10. After making the slot of the desired width and length, a second cut is made into liner 10. The second cut is made along each side of slot 12 thereby forming a berm 18 along each ,side of said slot. As shown in FIG. 2*a*, a key stone slot 20 has been modified by placing a berm or cut along each side of slot 20. FIG. 2*b* details a regular slot 20 containing a berm each side therealong. In order to make the slot of this invention, one cut penetrates liner 10. The second cut does not penetrate liner 10 but is cut to a depth of approximately one-third the thickness of the liner on each side of the slot which has penetrated liner 10. The combined width of the berms which are made or cut along each side of slot 12 is about four times the width of slot 14. In order to remove the desired amount of sand from a volume of hydrocarbonaceous fluids produced through slotted liner 10, a multiplicity of cuts are made to penetrate the slotted liner. The number of penetrating cuts which are made in the liner will depend upon the anticipated sand production from the formation when producing hydrocarbonaceous fluids therefrom. Each cut will contain a berm longitudinally along each slot. Cuts can be made either axially or radially within the liner to form slot 12.

Figure 3A:
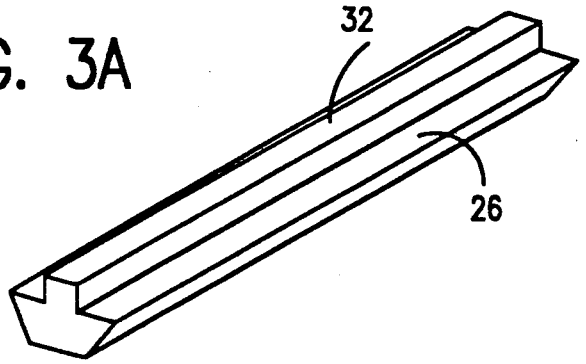
FIG. 3*a* is an enlarged view of the wire screen which is used to wrap the perforated liner.
Figure 3B:
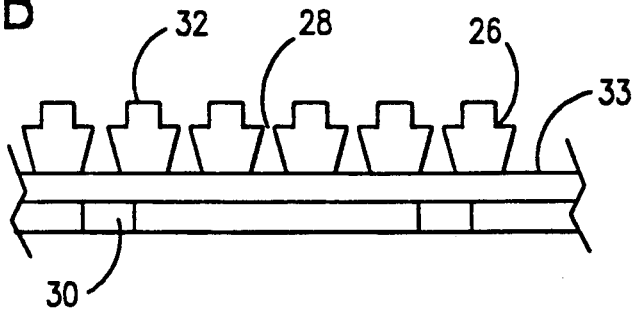
FIG. 3*b* is a sectional view of FIG. 3 along the line B—B which depicts the placement of adjacent wire wrappings that form a gap over the perforated liner and a longitudinal space bar.
Figure 4:
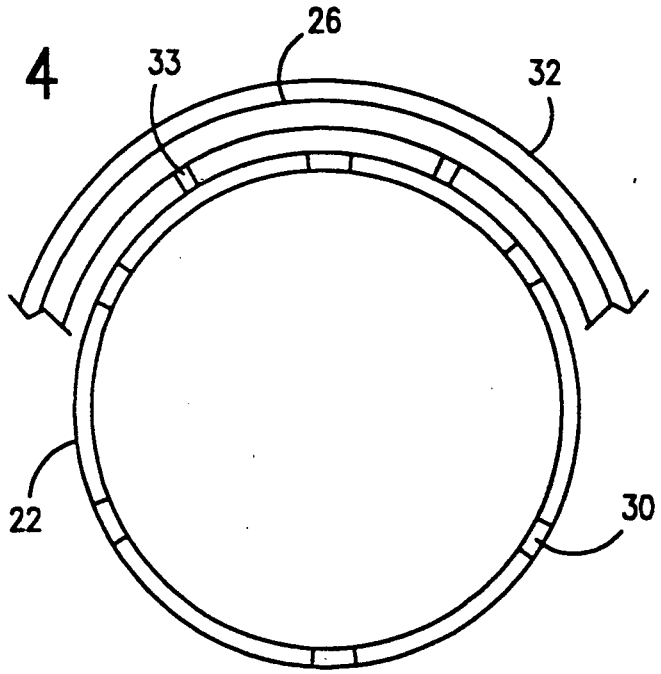
FIG. 4 is a sectional view of FIG. 3 along the line 4—4 which shows the placement of wire wrapping over longitudinal space bars.

In another embodiment as shown in FIG. 3, perforated pipe 22 with longitudinal spacer bars 33 is wrapped with a wire 24. The wire which is wrapped along the entire length of perforated pipe 22 has a space or gap 28 formed by adjacent wire wrappings. Space or gap 28 which remains between the wire wrappings is of a size sufficient to exclude sands which are anticipated will be produced from a formation along with hydrocarbonaceous fluids. FIG. 3*a* is an enlarged view of the wire which is used to wrap perforated pipe 22 and longitudinal spacer bars 33 so as to form the gaps 28 of a desired width. Wire 24 is wrapped circumferentially around perforated pipe 22 and supported off of perforated pipe 22 by longitudinal spacer bars 33 so as to form a sand-excluding gap 28 along the length of pipe 22. FIG. 4 illustrates how the wire is wrapped over longitudinal space bars 33 and perforated pipe 22. Wire 24 is shaped or formed to have a raised axial portion 32 with a berm 26 longitudinally along each side of the axial portion that causes a bridging of sand grains across a gap 28 which is formed with an adjacent wrapping of wire 24. An enlarged view of wire 24 is depicted in FIG. 3A. The adjacent wrappings combine to form a gap 28 in conjunction with hole 30 within perforated pipe 22. This is shown in FIG. 3*b*.

Figure 5:
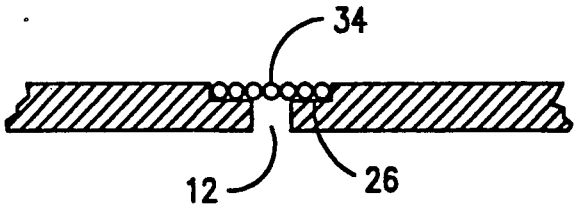
FIG. 5 is a schematic representation of a slot with berms therealong wherein sand grains have bridged the slot.

Berms 26 which are formed along gap 28 by the adjacent wire wrappings have a combined width of about four times the width of gap 28. Raised axial portion 32 has a height of about one-half that of the berm which is formed adjacent to said raised axial portion. The effect of berm 26 when used in combination with a wire-wrapped perforated pipe 22 with longitudinal spacer bars 33 or in combination with a slotted liner is to produce a shoulder on which sand grains can form a bridge 34 across gap 28. Sand bridge 34 is formed because berm 26 forms a stable platform whereby sand grains can become embedded and thereby provide a substantially more stable bridge which will effect better sand control. This bridging effect is demonstrated in FIG. 5.

In the practice of this invention, a wire-wrapped screen or a slotted liner as discussed above is affixed to the end of a production tube. This production tube is lowered into a well adjacent to a productive interval in the formation. As hydrocarbonaceous fluids are produced from said formation into the sand control device, sand accumulates in the berm adjacent to a slot in the liner or a gap over the perforated pipe so as to form a sand bridge. Hydrocarbonaceous fluids pushing up against the bridge cause additional sand to be removed from the fluids while substantially sand-free hydrocarbonaceous fluids are produced to the surface.

Obviously, many other variations and modifications of this invention as previously set forth may be made without departing from the spirit and scope of this invention as those skilled in the art readily understand. Such variations and modifications are considered part of this invention and within the purview and scope of the appended claims.

We claim:

1. A single walled sand control device for use in a well which comprises:

a single liner containing at least one slot that penetrates that liner and extends radially or axially therein which slot has a berm along each of its sides thereby causing a bridging of sand grains across said slot which results in substantially better sand control.

2. The device as recited in claim 1 where said berm penetrates said liner to about one-third of the liner's thickness.

3. The device as recited in claim 1 where a combined width of said berm along each side of the slot is about four times the slot's width.

4. The device as recited in claim 1 where a multiplicity of slots are contained in said liner.

5. A sand control device for use in a well comprising:

a) a perforated liner with longitudinal spacer bars affixed to the perforated liner; and b) wire wrapped circumferentially around said liner so as to form a sand excluding gap along the length of said liner which wire is shaped to have a raised axial portion with a berm longitudinally along each side of the axial portion that causes a bridging of sand grains across said gap which results in substantially better sand control.

6. The device as recited in claim 5 where said berm is about twice as wide as the raised axial portion.

7. The device as recited in claim 5 where a combined width of said berm along each side of the gap is about four times the gap's width.

8. A method for removing sand from hydrocarbonaceous fluids produced to the surface via a well comprising:

a) placing a single walled liner on the end of a tube used to produce hydrocarbonaceous fluids to the surface from a formation;

b) cutting at least one slot through said liner which extends radially or axially therein;

c) forming a berm along each side of said slot which causes a sand bridge to form across sail slot thereby removing substantially more sand from produced hydrocarbonaceous fluids.

9. The method as recited in claim 8 where said berm penetrates said liner to about one third of the liner's thickness.

10. The method as recited in claim 8 where a combined width of said berm along each side of the slot is about four times the slot's width.

11. The method as recited in claim 8 where a multiplicity of slots are contained in said liner.

* * * * *